US007134482B2

(12) United States Patent
Allen, Jr.

(10) Patent No.: US 7,134,482 B2
(45) Date of Patent: Nov. 14, 2006

(54) DEVICE AND METHOD TO IMPROVE THE LIFE OF CASTING MACHINE MOULDS

(76) Inventor: Thomas R. Allen, Jr., 7 Scalfe Rd., Sewickley, PA (US) 15143

( * ) Notice: Subject to any disclaimer, the term of this patent is extended or adjusted under 35 U.S.C. 154(b) by 0 days.

(21) Appl. No.: 11/211,195

(22) Filed: Aug. 25, 2005

(65) Prior Publication Data

US 2006/0042776 A1 Mar. 2, 2006

Related U.S. Application Data

(60) Provisional application No. 60/605,477, filed on Aug. 30, 2004.

(51) Int. Cl.
*B22D 11/06* (2006.01)

(52) U.S. Cl. ..... 164/429; 164/342; 164/324

(58) Field of Classification Search ..... 164/98, 164/479, 429, 342, 324, 329; 249/120, 135
See application file for complete search history.

(56) References Cited

U.S. PATENT DOCUMENTS 1,376,402 A * 5/1921 Coates ..... 249/82
3,385,070 A * 5/1968 Jackson ..... 405/243
4,605,055 A * 8/1986 Allen, Jr. ..... 164/72

* cited by examiner

*Primary Examiner*—Kevin Kerns
*Assistant Examiner*—Ing-Hour Lin
(74) *Attorney, Agent, or Firm*—Kirkpatrick & Lockhart Nicholson Graham LLP

(57) ABSTRACT

Reinforced moulds for a casting machine include a wall for containing a cast article, the wall including a lip region. The lip region includes a reinforcing element cast internally in the lip region. The reinforcing element provides enhanced resistance to tensile tearing and cracking of the moulds. Methods of making and using the reinforced moulds also are provided.

14 Claims, 7 Drawing Sheets

DEVICE AND METHOD TO IMPROVE THE LIFE OF CASTING MACHINE MOULDS

CROSS-REFERENCE TO RELATED APPLICATIONS

The present application claims priority under 35 U.S.C. § 119(e) to co-pending U.S. application Ser. No. 60/605,477, filed Aug. 30, 2004.

BACKGROUND OF THE TECHNOLOGY

1. Field of the Technology

The present disclosure relates generally to the casting of metal alloys, and more specifically to the continuous casting of metallic materials such as, for example, pig iron, ferroalloys, slag, and other materials into shapes for later use as feedstock or alloying elements for use in foundry and iron and steel making operations or like metallurgical processes.

2. Description of the Background of the Technology

Heretofore, moulds used on pig iron, ferroalloy, nickel matte, slag, and ingot casting machines have been made of various compositions of cast gray iron or steel. Cast irons with carbon in flake graphite form have been found to be the most successful in terms of mould life. Typical compositions are referred to by their tensile strength, e.g. Class 40 gray iron has a tensile strength of 40,000 pounds per square inch, and Class 20 gray iron has tensile strength of 20,000 pounds per square inch.

Unfortunately, the higher strength cast irons have poorer heat-transfer properties than the lower strength compositions. Since cracking is the primary cause of failure of moulds on casting machines, it would be expected that the higher strength types would be more resistant to early failure. Unfortunately, this has not been the case, since the higher strength iron compositions do not effectively conduct the heat from the molten metal through the mould body, and can suffer local pitting and erosion in the area where the metal stream impacts the moulds. In the case of use with high temperature ferroalloys, the moulds erode severely at the metal impingement point.

The lower strength compositions do an excellent job of conducting heat, but their lower physical strength makes them prone to early failure from cracking.

It can, therefore, be appreciated that a significant advantage can be obtained by a method for manufacturing moulds of lower physical strength that are reinforced to provide resistance to cracking and subsequent breakage.

SUMMARY

The present disclosure provides a design of casting machine moulds that greatly increases the life of the moulds. Such molds may be used on, for example, pig iron, ferroalloy, nickel matte, slag, and ingot casting machines. The moulds according to the present disclosure include one or more reinforcing elements in at least a lip region of the moulds.

The present disclosure also is directed to a method that includes providing one or more reinforcing elements within the mould from which the castings will be made prior to casting the moulds, resulting in increased resistance to cracking in the area where crack propagation normally begins during use of the moulds.

The present disclosure also is directed to a method for production of moulds for use on, for example, pig iron, ferroalloy, nickel matte, slag, and ingot casting machines, the method comprising providing one or more reinforcing elements in the mould from which the pig or ingot mould castings are produced, at a location which provides added strength to the lip region of the mould castings, allowing the use of mould materials that provide the most efficient heat-transfer. According to certain non-limiting embodiments of the method, the method also may include pickling the reinforcement elements prior to casting the elements into the lip region, thereby preventing oxidation when surrounded by molten iron.

One possible type of casting apparatus in which moulds according to the present disclosure may be used comprises a continuous casting machine of conventional design, having a plurality of iron moulds arranged in an endless train. The opposed ends of each mould are attached to a pair of endless chains, which are suspended between a set of idler sprockets at the pouring end and a set of drive sprockets at the discharge end of the casting machine in a conventional manner. The endless chains are either provided with wheels mounted within the chain links, or supported by fixed rollers mounted on the machine frame. In either case, the moulds are attached to the chains by bolting or other conventional means. The mould train and drive assembly are mounted on a steel framework of conventional design.

Molten metal is transferred from the melting furnace by ladle or other means into a pouring launder mounted on the casting machine. As the moulds are continuously transported under the stream or streams of molten metal or alloy, the material fills the moulds and solidifies into the desired shapes. Conventional casting machines also include a plurality of conventional water spray units, which direct water on to the moulds and the cast bodies in spaced relationship from the pouring launder. Additional water sprays may also be mounted below the train of moulds to cool the outside bottom surface of the moulds and to improve the heat transfer through the mould bottom and walls.

After the cast body has been cooled and solidified, the moulds travel around a set of sprockets at the drive end, causing the moulds to invert, which permits the cast body to fall by gravity into a discharge chute. The discharge of the cast body from the moulds may also be assisted by a conventional rapping device that imparts a sharp blow to the mould or to the cast body at the discharge end. The empty moulds then travel toward the pouring end of the casting machine in an inverted position to be filled again.

It will be understood that the foregoing conventional casting apparatus is only one example of a casting apparatus with which embodiments of the methods and devices according to the present disclosure may be used. Other designs of casting apparatus with which the methods and devices may be used will be apparent to those having ordinary skill in the casting art.

BRIEF DESCRIPTION OF THE DRAWINGS

The features and advantages of the alloys and articles described herein may be better understood by reference to the accompanying drawing in which.

DESCRIPTION OF CERTAIN NON-LIMITING EMBODIMENTS

Other than in the operating examples, or where otherwise indicated, all numbers expressing dimensions used in the present description and claims are to be understood as being modified in all instances by the term "about". Accordingly, unless indicated to the contrary, any numerical parameters set forth in the following description and the attached claims are approximations that may vary depending upon the desired characteristics one seeks to obtain in articles according to the present disclosure. At the very least, and not as an attempt to limit the application of the doctrine of equivalents to the scope of the claims, each numerical parameter should at least be construed in light of the number of reported significant digits and by applying ordinary rounding techniques Notwithstanding that the numerical ranges and parameters setting forth the broad scope of the present disclosure are approximations, the numerical values set forth in any specific examples herein are reported as precisely as possible. Any numerical values, however, inherently contain certain errors, such as, for example, equipment and/or operator errors, necessarily resulting from the standard deviation found in their respective testing measurements. Also, it should be understood that any numerical range recited herein is intended to include the range boundaries and all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10

Figure 1:
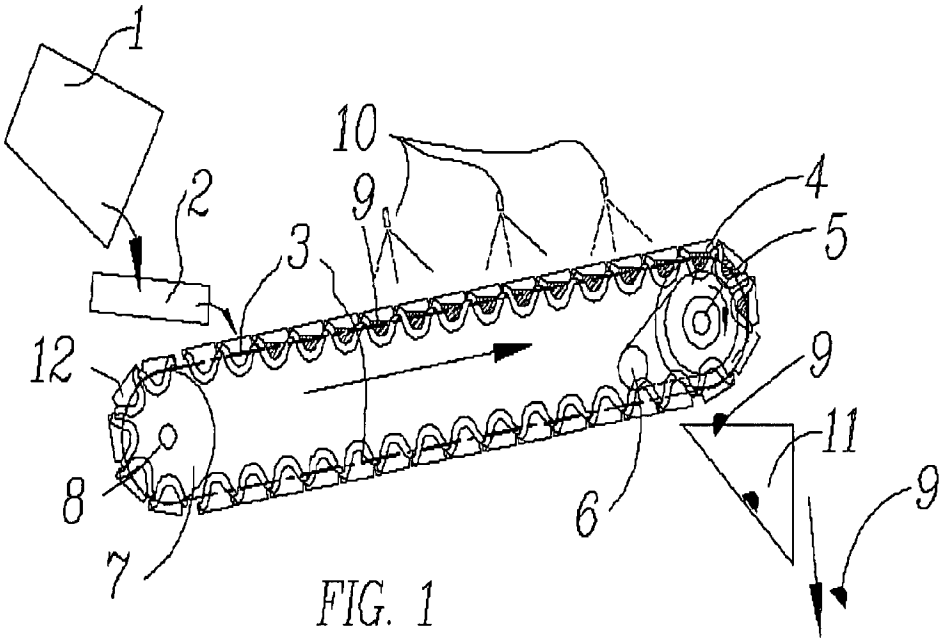
FIG. 1 is a partial, cut-away side elevation of a typical casting machine, with which embodiments of the methods and devices according to the present disclosure may be used.
Figure 2:
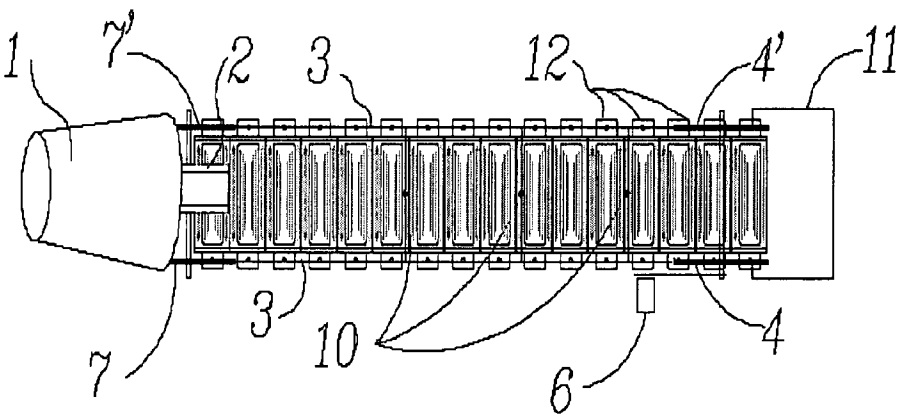
FIG. 2 is a plan view of the casting machine shown in FIG. 1.

Referring now to the drawings and specifically to FIGS. 1 and 2, a typical cross-section of a conventional casting machine is depicted in FIG. 1, with the plan view shown in FIG. 2. The mechanical structure of the casting machine is similar to those used in pig iron casting machines. Metal flows from a ladle or furnace 1, through a pouring launder 2, into a moving strand of moulds, made up of moulds 12 mounted on endless chains 3. The endless chains 3 are mounted on idler sprockets 7 and 7', mounted on a tail shaft or axle 8 and a pair of driven head sprockets 4 and 4', mounted on a head shaft or axle 5, at the opposite end. The head sprockets 4 and 4' are turned by a roller chain drive or gear box and a motor 6, which causes the head sprockets to rotate and move the endless chains. A plurality of ferrous moulds generally designated 12, are mounted to the chain elements by way of a conventional attachment method. The specific features of the moulds 12 will be discussed in greater detail hereinafter.

The casting machine depicted in FIG. 1 is inclined in a conventional manner such that the head sprockets 4 and 4' are sloped higher in elevation than the tail sprockets 7 and 7', so that the molten metal or ferroalloy material achieves a uniform level within the moulds, with the excess liquid material flowing over appropriate channels to the mould immediately adjacent and behind a mould previously filled.

Still referring to FIG. 1, the casting machine is also equipped with a number of conventional spray nozzles 10, to provide water spray cooling to accelerate the solidification of the pigs or ingots 9.

The empty moulds 12 proceed around the idler sprockets 7 and 7' to an upright position where they are filled with molten metal or ferroalloy material beneath the pouring launder 2. The filled train of moulds 3 and 12 moves upwardly on the casting machine and, within several seconds after pouring, a solid skin of solidified metal forms on the top of each of the castings. In order to quickly chill the castings, such as the casting 9 shown in FIG. 1, the casting machine also includes one or more conventional water sprays 10. Spray heads 10 provide a spray of atomized water onto the top surface of the moulds 12 and the pigs and ingots 9, to provide more rapid cooling of the cast body and mould.

After the cast bodies and moulds 9 and 12 pass beneath the water sprays 10, they reach the driving sprockets 4 and 4' and the moulds are moved to an inverted position by the endless chains 3 as they pass over the drive sprockets. As can be seen in FIG. 1, the casting machine is provided with a discharge chute 11 which directs the individual castings into a suitable collection bin or like collection means.

In order to assist the discharge of the castings 9 from the moulds, a mechanical mould rapper of conventional design, may be provided at the discharge end of the casting machine. Such a device imparts a blow to the mould 12 or to the cast body 9. The mould rapper may be powered by a spring, counterweight, or air cylinder. In conventional designs, a system is also normally used to spray a mould release coating into the mould cavities, to assist in release of the cast bodies from the moulds.

Figure 3:
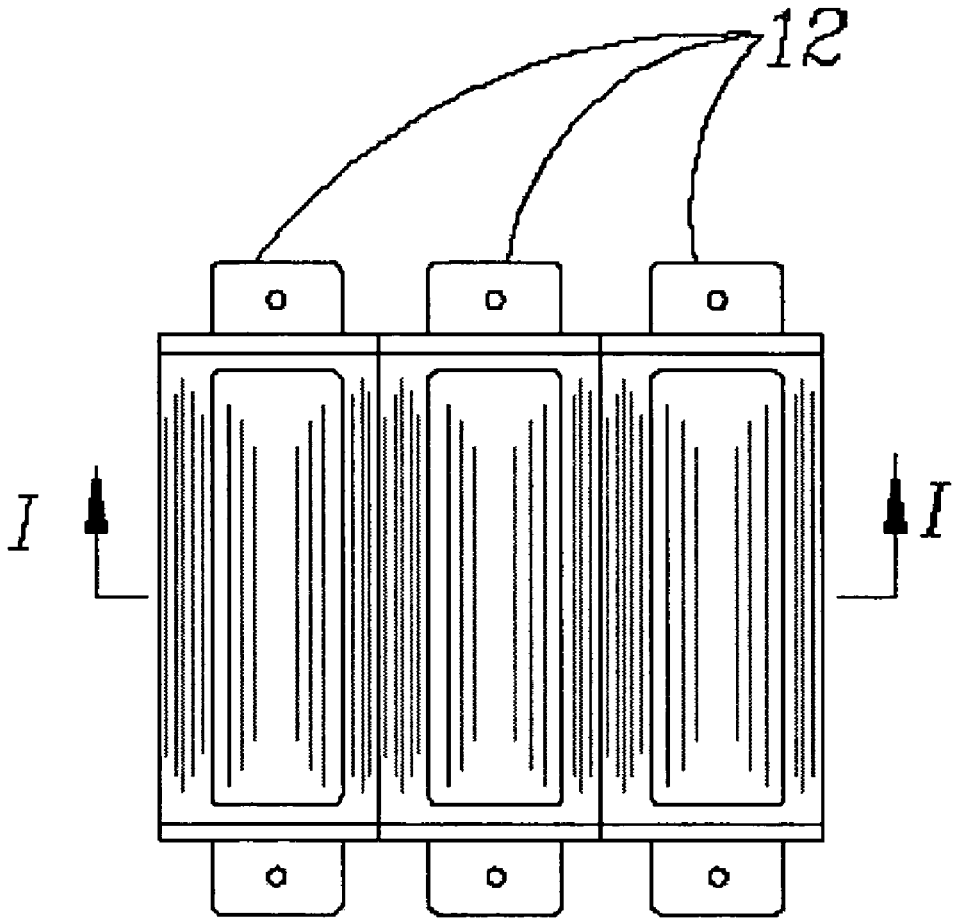
FIG. 3 is a partial plan view showing a more detailed view of three typical casting machine moulds as would typically be mounted on the machine shown in FIG. 1.

FIG. 3 shows three typical empty pig moulds such as are conventionally mounted on the endless chains of a pig casting machine.

Figure 4:
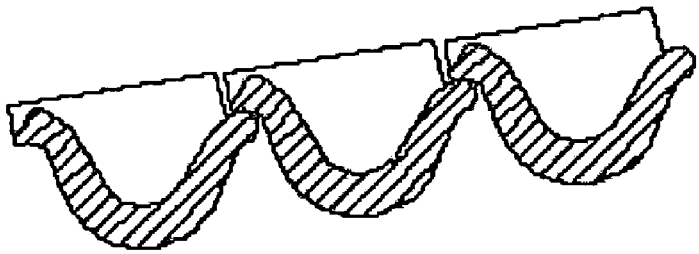
FIG. 4 is a section taken along lines I—I of FIG. 3 showing empty moulds.

FIG. 4 shows a cross-section through those moulds.

Figure 5:
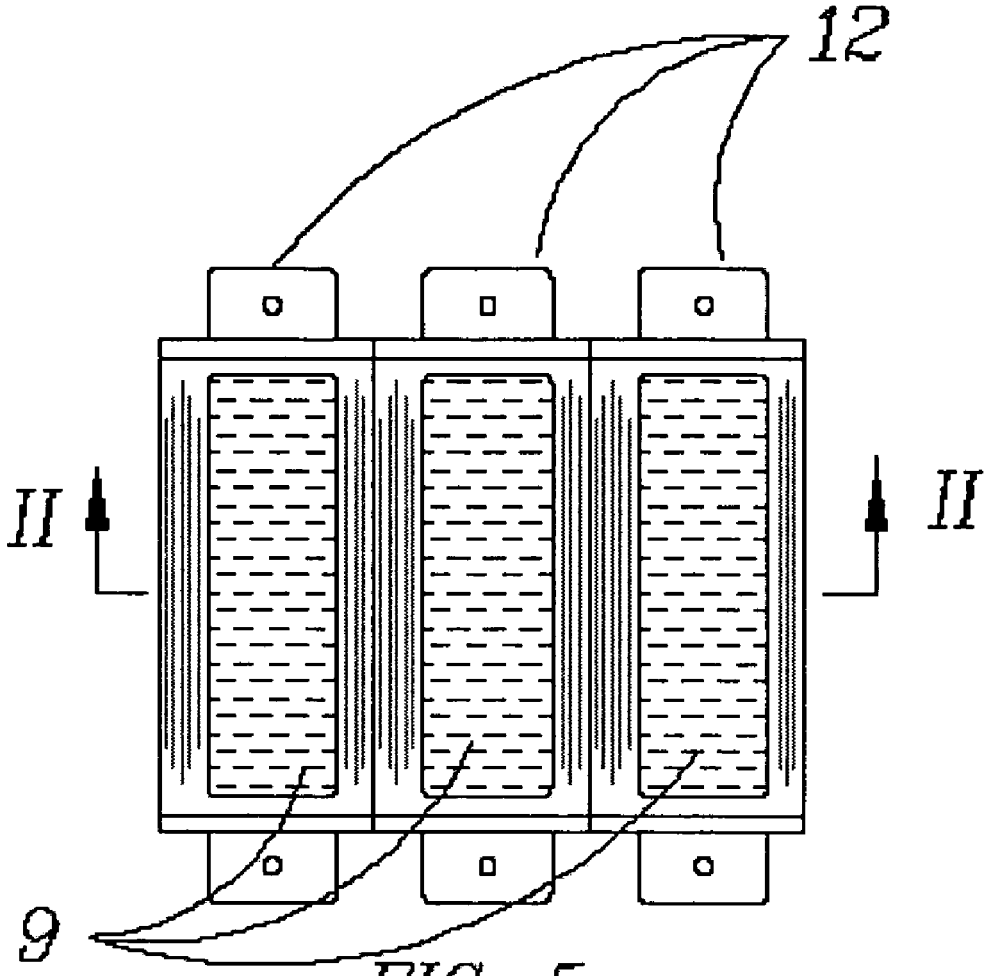
FIG. 5 is a plan view of the moulds shown in FIG. 3, but showing them filled with molten metal.

FIG. 5 shows the same moulds 12, as they appear when filled with metal, which has been introduced into the moulds from pouring launder 2.

Figure 6:
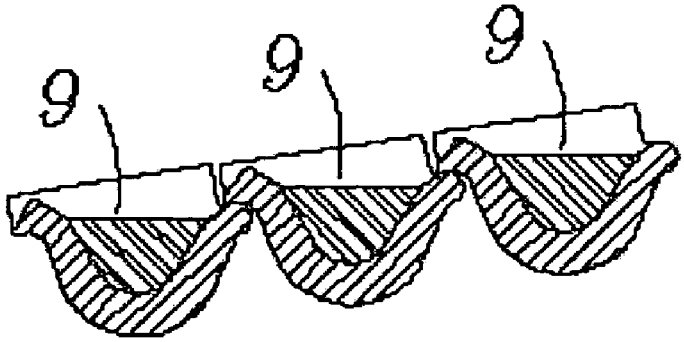
FIG. 6 is a section taken along lines II—II of FIG. 5.

FIG. 6 shows a cross sectional view of the moulds in FIG. 5, with the cast body designated as 9.

Figure 7:
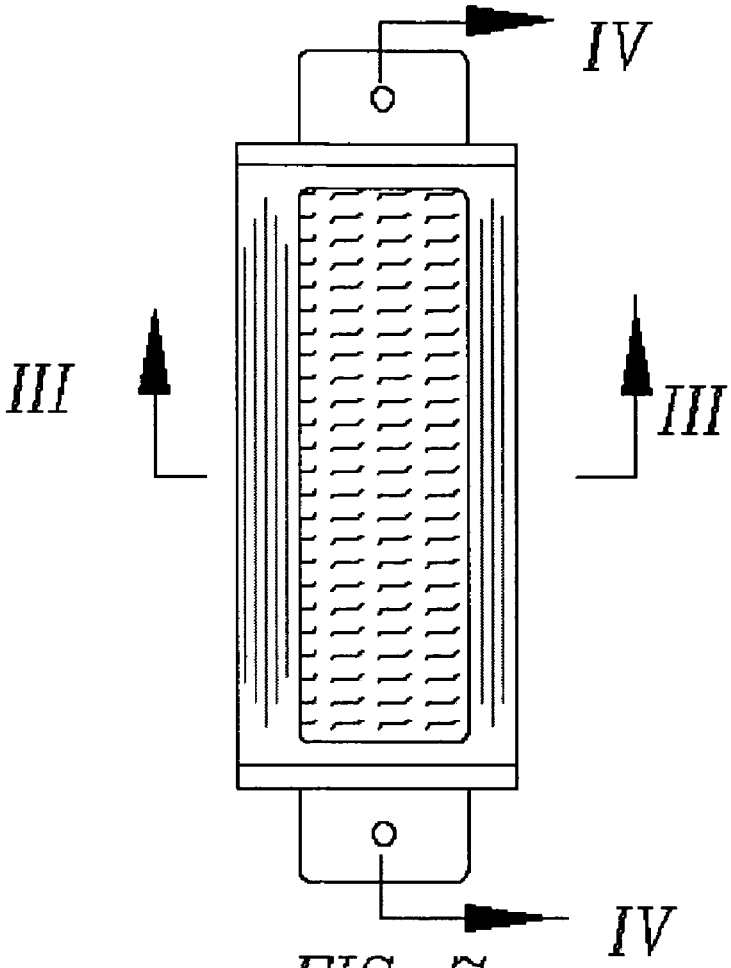
FIG. 7 is a plan view of a single mould of the machine shown in FIG. 1, wherein the mould is filled with molten metal.

FIG. 7 shows a plan view of a typical mould, filled with hot metal

Figure 8:
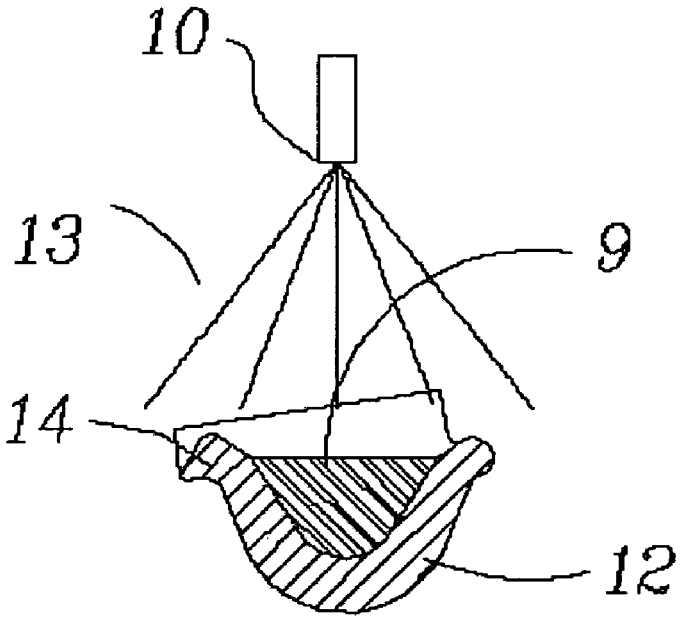
FIG. 8 is a section taken along lines III—III of FIG. 7, showing the water spray apparatus shown in FIG. 1.

FIG. 8 shows the position of the mould 12 and cast body 9 passing under a water spray 10 that emits streams of atomized water 13, which impinge on both the cast body and the mould. As can be observed from the illustration, the lip region of the mould 14 is exposed directly to the cooling effect of the water spray, while the balance of the mould 12 remains at a far higher temperature, since it is filled with metal which is solidifying as the mould train travels toward the discharge point around the driven sprockets 4 and 4'.

Figure 9:
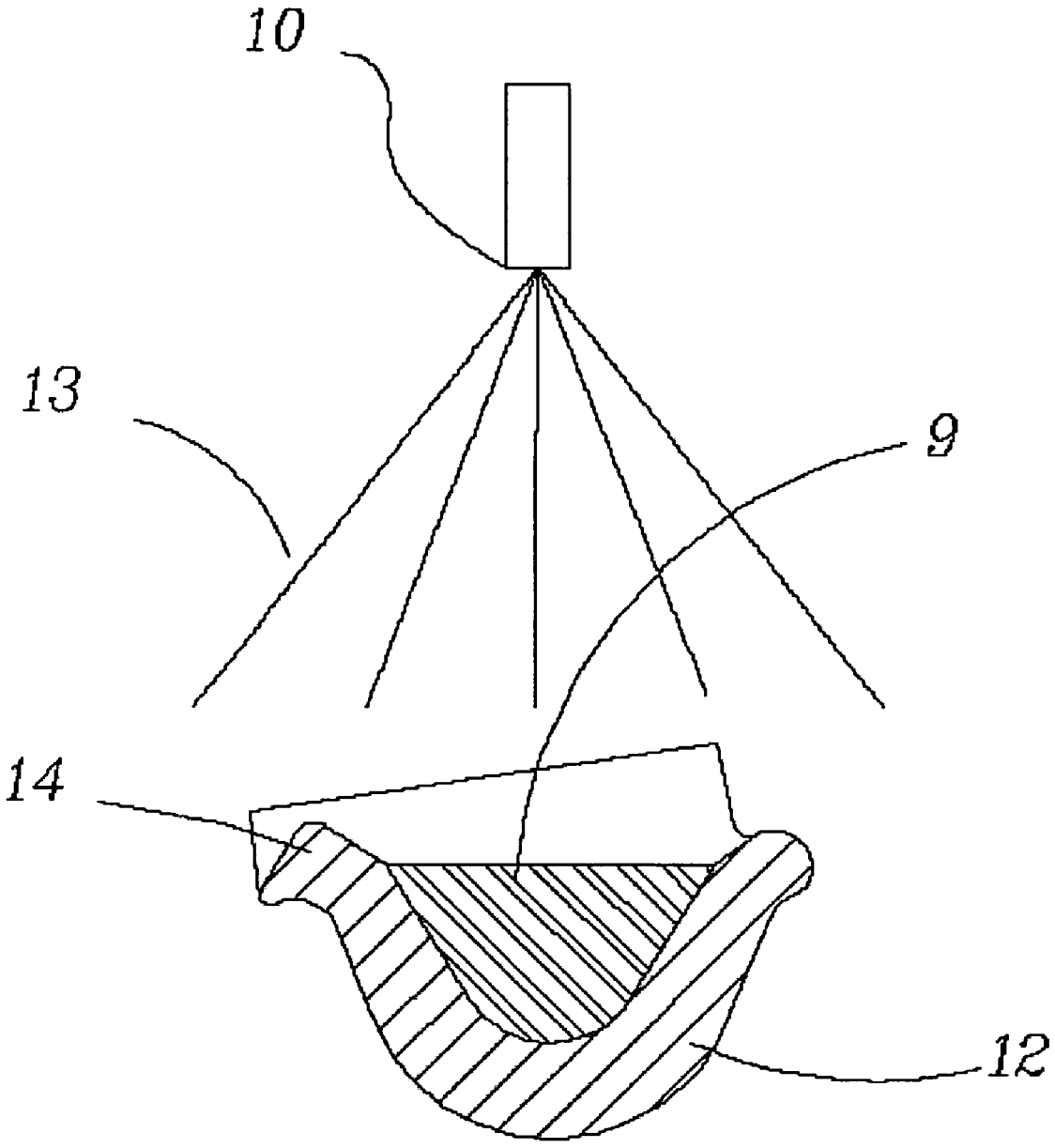
FIG. 9 is an enlarged view of FIG. 8.

FIG. 9 shows an enlarged view of the mould shown in FIG. 8 with the mould lip region again designated 14. Since the main body of the mould 12 is filled with molten and solidifying metal, its temperature is elevated, causing the mould to expand in length. The mould lip region 14, however, is being quenched by the water spray 13, sprayed from the spray nozzles 10. The cooling effect of the water spray causes the metal in the lip region 14 to contract relative to the main body of the mould 12. Thus, the main body of the mould, which is filled with molten metal, undergoes thermal expansion, while the lip region containing the embedded reinforcing bar 16 is placed in tension as it is cooled by the water sprays 13 that are sprayed from nozzles 10, and attempts to contract. The combined result of these two effects is to place the lip region of the mould 14 in tension relative to the main body 12 of the moulds, since it attempts to shrink longitudinally from the effect of the cooling water sprays while the main body of the mould is still expanding from the heat transferred to it by the cast body 9. Since cast iron has a relatively low tensile strength, this force, over time, causes tears in the metal of the mould lip region 14. The presence of flake graphite in the type of gray iron typically used in ingot moulds provides weak spots in the mould, with lower resistance to tensile forces. This weak area generally is the first area from which the cracks propagate.

In nearly every case of mould failure, the initial cracking of pig and ingot moulds has been observed as beginning in the mould lip region, then propagating through the cross-section of the casting. Ultimately, the crack extends across the entire mould, resulting in the mould being broken in two.

Figure 13:
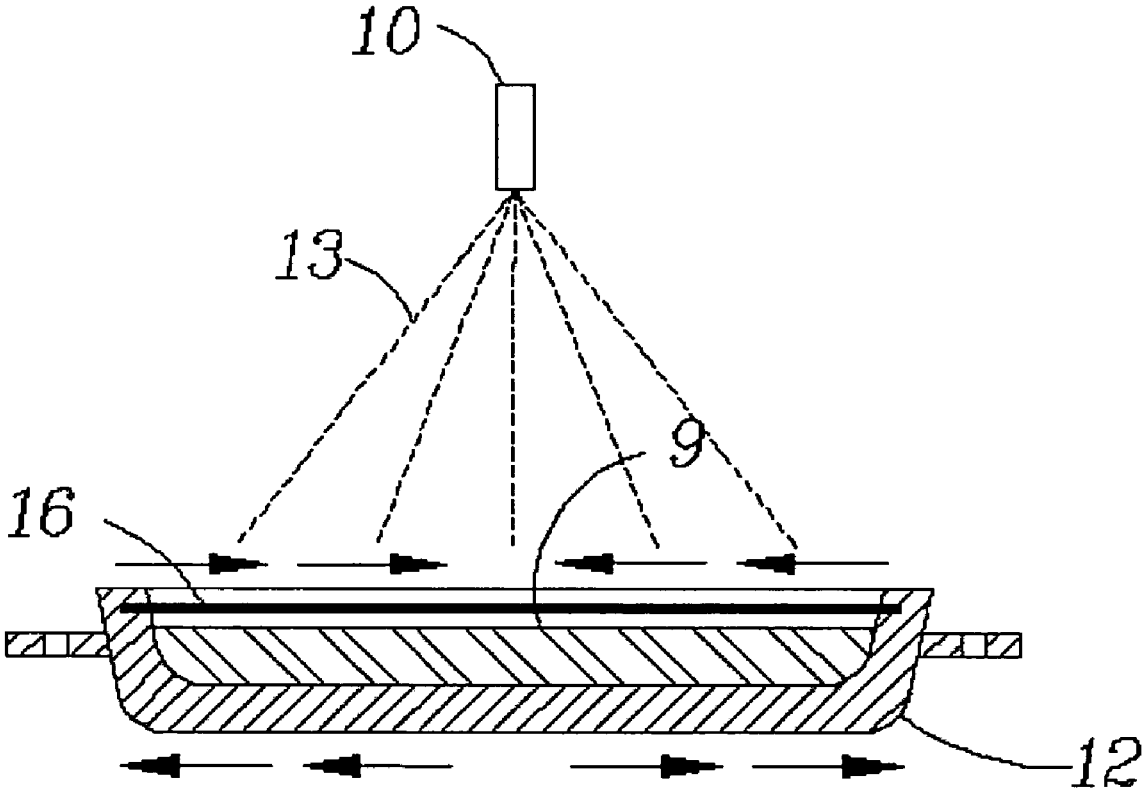
FIG. 13 is a section taken along lines IV—IV of FIG. 7 showing the position of the reinforcement and the effect of thermal expansion.

The relative expansion and contraction forces resulting from the main body of the mould being filled with metal, and the projecting lip region being cooled by the water sprays is shown on FIG. 13.

Figure 10:
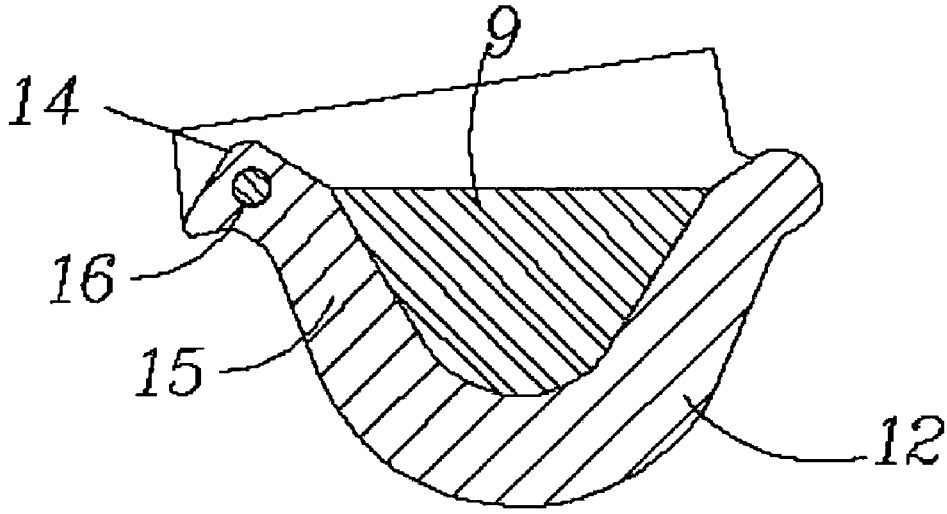
FIG. 10 is a view of the mould cross-section shown in FIG. 9, and wherein a steel reinforcement bar has been inserted at the mould lip region.
Figure 11:
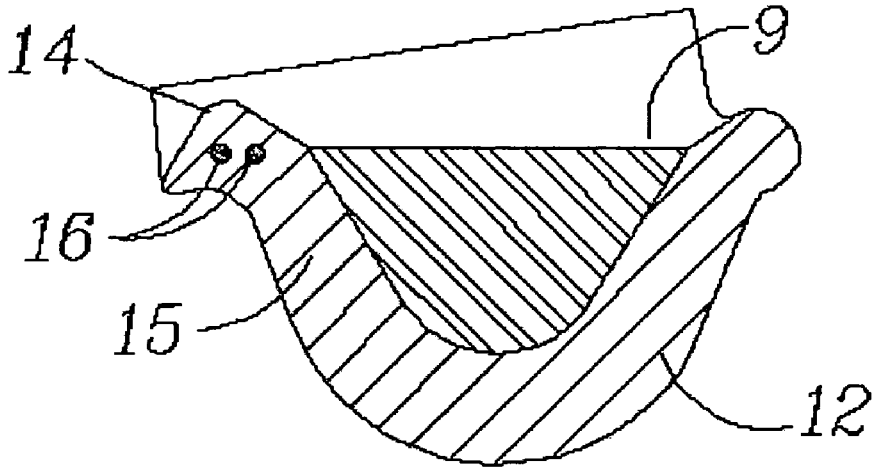
FIG. 11 is a section taken along lines III—III of FIG. 7, and wherein multiple reinforcement bars have been inserted.
Figure 12:
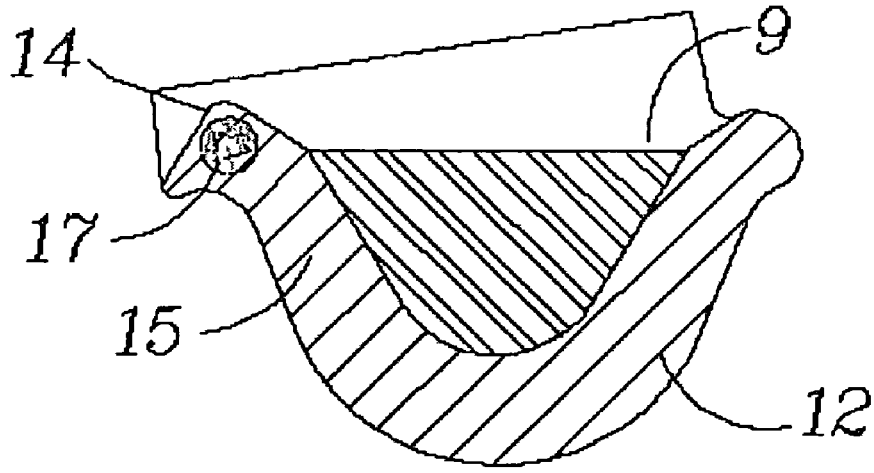
FIG. 12 is a section taken along lines III—III of FIG. 7, and wherein randomly dispersed metal filaments or wires have been inserted in the mould.

The inventor has determined that by reinforcing the mould lip region with one or more reinforcing members, such as steel reinforcing bars 16 shown in FIGS. 10 and 11 and discussed below, the ability of the mould lip region to resist tensile cracking is greatly enhanced. Alternatively, this reinforcement can be accomplished by the use of reinforcing means other than those discussed below. For example, FIG. 12 shows the insertion of randomly distributed metallic filaments or wires in the mould lip region which are an alternative means of reinforcement. Such wires or filaments, for example, could be randomly distributed within the lip region, as well as within other regions of the mould. Those having ordinary skill, upon considering the present disclosure, will be able to identify additional reinforcing element compositions, shapes, and distributions within the lip region, and all such alternate embodiments are within the scope of the present disclosure. By impeding the formation of tensile tearing and cracking, the life of the mould is therefore greatly extended.

In a field test program in a nickel matte smelting plant, the life of embodiments of moulds designed according to the present disclosure was greatly extended. Eight experimental moulds were made by modifying the design of conventional moulds. In four experimental moulds having a first modified mould design, referred to herein as Modified Mold #1, a single 12 mm (½ inch) steel reinforcing bar was cast into the lip region of a cast iron mold having a conventional design. The design of Modified Mold #1 is generally shown in FIGS. 10 and 13, wherein main body 12 includes mould wall 15 supporting cast body 9. Lip region 14 of includes steel reinforcing bar 16 which, as shown in the cross section of FIG. 13, extends substantially along the length of lip region 14. In four moulds made with a second experimental design, referred Modified Mold #2, two 6 mm (¼% inch) steel reinforcing bars were cast into each mould lip region. The design of Modified Mold #2 is generally shown in FIGS. 11 and 13, wherein main body 12 includes mould wall 15 supporting cast body 9. Lip region 14 includes two steel reinforcing bars 16 which, as shown in the cross section of FIG. 13, each extend substantially along the length of lip region 14.

Nickel matte ingots were cast using both modified mould experimental mould designs, as well as an unmodified conventional mould identical in all respects to the experimental moulds, but lacking any reinforcing elements in the mould lips. Moulds having the conventional design failed after about 150 casts (375 re-fillings). In contrast, both types of reinforced experimental moulds did not fail until after 620 casts (1,550 re-fillings). Accordingly, the experimental moulds achieved a life approximately 400% greater than the life of moulds having a conventional design. The substantial increase in mould life will increase casting throughput, decrease downtime for mould replacement, and generally reduce costs associated with casting.

During the experimental casting runs, it was observed that the larger diameter reinforcing element had a tendency to chill the cast iron mould, which could reduce mould life. Thus, the experimental mould design incorporating multiple, relatively smaller diameter reinforcing elements is considered the preferred design of the two experimental designs tested. In the case in which reinforcing elements used in embodiments of reinforced moulds according to the present disclosure are one or more bar-shaped or rod-shaped reinforcing elements, the diameter of the elements preferably is greater than 0.8 mm (about 1/32 inch) and less than 25 mm (about 1 inch)

Certain materials used as reinforcing elements in certain non-limiting embodiments of reinforced moulds according to the present disclosure may be materials subject to oxidative corrosion. An example of one such material subject to oxidation is carbon steel. In the case of embodiments including reinforcing elements subject to oxidation, pickling the reinforcing elements by acid dipping and neutralization or other means before inserting them into the moulds from which the pig and ingot moulds are produced can be advantageous. The pickling step may remove oxidation products from the outer surface of the reinforcing elements before the elements are cast internally into the moulds. If left on the outer surface, the oxidation products can cause gas to be generated as the mould casting is produced, preventing intimate contact of the reinforcing elements with the material used to form the balance of the mould body.

In general, reinforcing elements of any composition, shape, and distribution that suitably strengthens the lip region and thereby extend the service life of the moulds may be used. Non-limiting examples of possible shapes of reinforcing elements include elongate shapes. In one non-limiting embodiment of a reinforced mould according to the present disclosure, the reinforcing element included in the lip region of the mould is a length of standard deformed steel reinforcing bar typically used for reinforcing concrete. More generally, the reinforcing elements may be composed of any metallic material having a higher melting point than the material from which the mould is manufactured.

According to one possible method for making a reinforced casting machine mold according to the present disclosure, at least one reinforcing element is disposed at a predetermined position within a mould adapted for casting the casting machine mould. The predetermined position is selected so that the reinforcing element will be in a lip region of the casting machine mold and will enhance resistance of the casting machine mould to tensile tearing and cracking. A molten metallic material is poured into the mould to form the casting machine mold and thereby cast the reinforcing element internally in a lip region of the casting machine mould. Other methods for producing moulds according to the present disclosure will be evident to those of ordinary skill upon considering the present disclosure.

One possible non-limiting embodiment of a wire or filament that may be used as a reinforcing element in mould embodiments according to the present disclosure is stainless steel wire with a diameter less than 6 mm (about ¼ inch) in diameter and length greater than 6 mm (about ¼ inch). One possible means of incorporating metallic wires or filaments in the mould lip region would be to encase the filaments or wires in a material that will melt when exposed to the mould material during casting of the mould, and which is shaped so as to suitably maintain the relative positions of the reinforcing filaments or wires in the mould lip region after the temporary carrier melts. Wax is one possible temporary carrier in which the wires or filaments may be encased. The wax melts and decomposes when the moulds are cast, leaving the filaments or wires in place in the lip region in the cast mould.

In certain non-limiting embodiments of reinforced moulds accoriding to the present disclosure, the reinforcing elements, such as filaments or wires, are provided in areas of the mould in addition to the lip region. In certain of these embodiments, the reinforcing elements are filaments or wires that are internally cast at regions throughout the mould body.

Although the foregoing description has necessarily presented a limited number of embodiments of the invention, those of ordinary skill in the relevant art will appreciate that various changes in the compositions and other details of the examples that have been described and illustrated herein in order to explain the nature of the invention may be made by those skilled in the art, and all such modifications will remain within the principle and scope of the invention as expressed herein and in the appended claims. It will also be appreciated by those skilled in the art that changes could be made to the embodiments above without departing from the broad inventive concept thereof. It is understood, therefore, that this invention is not limited to the particular embodiments disclosed, but it is intended to cover modifications that are within the principle and scope of the invention, as defined by the claims.

I claim:

1. A casting machine mould for a casting machine, the casting machine adapted for continuous casting of metallic material in a plurality of moulds, the casting machine mould comprising a wall and a bottom for containing a cast article, the wall including a lip region, wherein the lip region includes a reinforcing element cast internally in the lip region, the reinforcing element providing enhanced resistance to tensile tearing and cracking of the mould.

2. The mould of claim 1, wherein the casting machine is for continuous casting at least one of pig iron, nickel matte, slag, and ferroalloy in a plurality of moulds.

3. The mould of claim 1, wherein the reinforcing element is an elongate steel element.

4. The mould of claim 1, wherein the reinforcing element is composed of a material with a melting point greater than a material from which the wall of the mould is composed.

5. The mould of claim 4, wherein the reinforcing element is one of a steel bar and a steel rod.

6. The mould of claim 4, wherein a diameter of the reinforcing elements greater than 0.8 mm and less than 25 mm.

7. The mould of claim 4, wherein the reinforcing element is a length of standard deformed concrete reinforcing bar.

8. The mould of claim 1, wherein the reinforcing element has been treated to remove products of oxidation from a surface of the reinforcing element.

9. The mould of claim 8, wherein the reinforcing element has been pickled.

10. The mould of claim 1, wherein at least two reinforcing elements are cast internally in the lip region of the mould.

11. The mould of claim 10, wherein the reinforcing elements are at least one of metallic filaments and metallic wires.

12. The mould of claim 11, wherein the reinforcing elements are at least one of stainless steel filaments and stainless steel wire.

13. The mould of claim 11, wherein the metal filaments or wires are dispersed throughout the mould casting.

14. The mould of claim 11, wherein the reinforcing elements are composed of stainless steel and have a diameter less than 6 mm and a length greater than 6 mm.

* * * * *

UNITED STATES PATENT AND TRADEMARK OFFICE

CERTIFICATE OF CORRECTION

PATENT NO. : 7,134,482 B2
APPLICATION NO. : 11/211195
DATED : November 14, 2006
INVENTOR(S) : Thomas R. Allen, Jr.

It is certified that error appears in the above-identified patent and that said Letters Patent is hereby corrected as shown below:

Inventor, delete "Scalfe" and substitute --Scaife--

Column 5, line 65, delete "14 of includes" and substitute --14 includes--

Column 6, line 2, delete "referred Modified" and substitute --referred to as Modified--

Column 7, line 27, delete "accoriding" and substitute --according--

Column 8, line 23, delete "elements" and substitute --element is--

Column 8, line 42, delete "metal" and substitute --metallic--

Signed and Sealed this

Ninth Day of March, 2010

David J. Kappos

David J. Kappos
*Director of the United States Patent and Trademark Office*